US009423733B2

(12) United States Patent
Fujiwara

(10) Patent No.: US 9,423,733 B2
(45) Date of Patent: Aug. 23, 2016

(54) SHEET PROCESSING APPARATUS AND IMAGE FORMING APPARATUS HAVING THE SAME

(71) Applicants: KABUSHIKI KAISHA TOSHIBA, Tokyo (JP); TOSHIBA TEC KABUSHIKI KAISHA, Tokyo (JP)

(72) Inventor: Shigeru Fujiwara, Yokohama Kanagawa (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/588,700

(22) Filed: Jan. 2, 2015

(65) Prior Publication Data

US 2016/0195839 A1 Jul. 7, 2016

(51) Int. Cl.
*G03G 15/20* (2006.01)

(52) U.S. Cl.
CPC ..... *G03G 15/205* (2013.01)

(58) Field of Classification Search
CPC ..... G03G 15/2078
USPC ..... 399/45, 69; 347/45
See application file for complete search history.

(56) References Cited

U.S. PATENT DOCUMENTS 6,014,531 A * 1/2000 Ebata ..... G03G 15/2039 399/45
8,538,280 B2 9/2013 Yahata et al.
2012/0321335 A1* 12/2012 Fujiwara ..... G03G 15/2078 399/69

* cited by examiner

*Primary Examiner* — Lam Nguyen
(74) *Attorney, Agent, or Firm* — Patterson & Sheridan, LLP

(57) ABSTRACT

A sheet processing apparatus includes a rotating unit, a pressing unit, a nip being formed therebetween, a first heating unit configured to heat the rotating unit, a second heating unit configured to heat the pressing unit, and a control unit. The control unit is configured to control the first and second heating units according to a mode of operation, such that, in a first mode, the rotating unit at the nip is at a first temperature and the pressing unit at the nip is at a second temperature, and in a second mode, the rotating unit at the nip is at a third temperature that is equal to or higher than the first temperature and the pressing unit at the nip is at a fourth temperature that is higher than the second temperature. A difference between the second and fourth temperatures is smaller than between the first and third temperatures.

14 Claims, 9 Drawing Sheets

| | | FIRST CONDITION | | SECOND CONDITION | |
|---|---|---|---|---|---|
| | | HEATING ROLLER | PRESSING BELT | HEATING ROLLER | PRESSING BELT |
| CONTROL TEMPERATURE | FIRST IMAGE FORMING MODE (ERASABLE TONER) | 100℃ | 90℃ | 100℃ | 90℃ |
| | SECOND IMAGE FORMING MODE (NON-ERASABLE TONER) | 120℃ | 110℃ | 130℃ | 90℃ |
| | COLOR ERASING MODE | 130℃ | 120℃ | 140℃ | 100℃ |
| WARMING-UP TIME (ORDINARY TEMPERATURE) | FIRST IMAGE FORMING MODE (ERASABLE TONER) | 42sec | 58sec | 42sec | 58sec |
| | SECOND IMAGE FORMING MODE (NON-ERASABLE TONER) | 54sec | 110sec | 62sec | 58sec |
| | COLOR ERASING MODE | 62sec | 152sec | 70sec | 58sec |
| SWITCH TIME (WARMING-UP TIME) | SWITCH FROM FIRST IMAGE FORMING MODE TO SECOND IMAGE FORMING MODE | 13sec | 52sec | 21sec | 0sec |
| | SWITCH FROM FIRST IMAGE FORMING MODE TO COLOR ERASING MODE | 21sec | 94sec | 29sec | 22sec |
| | SWITCH FROM SECOND IMAGE FORMING MODE TO COLOR ERASING MODE | 8sec | 38sec | 8sec | 22sec |
| SWITCH TIME (COOL DOWN TIME) | SWITCH FROM SECOND IMAGE FORMING MODE TO FIRST IMAGE FORMING MODE | 50sec | 158sec | 79sec | 0sec |
| | SWITCH FROM COLOR ERASING MODE TO FIRST IMAGE FORMING MODE | 79sec | 389sec | 114sec | 0sec |
| | SWITCH FROM COLOR ERASING MODE TO SECOND IMAGE FORMING MODE | 29sec | 231sec | 35sec | 0sec |

| | | FIRST CONDITION | | SECOND CONDITION | |
|---|---|---|---|---|---|
| | | HEATING ROLLER | PRESSING BELT | HEATING ROLLER | PRESSING BELT |
| CONTROL TEMPERATURE | FIRST IMAGE FORMING MODE (ERASABLE TONER) | 100℃ | 90℃ | 100℃ | 90℃ |
| | SECOND IMAGE FORMING MODE (NON-ERASABLE TONER) | 120℃ | 110℃ | 130℃ | 90℃ |
| | COLOR ERASING MODE | 130℃ | 120℃ | 140℃ | 100℃ |
| WARMING-UP TIME (ORDINARY TEMPERATURE) | FIRST IMAGE FORMING MODE (ERASABLE TONER) | 42sec | 58sec | 42sec | 58sec |
| | SECOND IMAGE FORMING MODE (NON-ERASABLE TONER) | 54sec | 110sec | 62sec | 58sec |
| | COLOR ERASING MODE | 62sec | 152sec | 70sec | 58sec |
| SWITCH TIME (WARMING-UP TIME) | SWITCH FROM FIRST IMAGE FORMING MODE TO SECOND IMAGE FORMING MODE | 13sec | 52sec | 21sec | 0sec |
| | SWITCH FROM FIRST IMAGE FORMING MODE TO COLOR ERASING MODE | 21sec | 94sec | 29sec | 22sec |
| | SWITCH FROM SECOND IMAGE FORMING MODE TO COLOR ERASING MODE | 8sec | 38sec | 8sec | 22sec |
| SWITCH TIME (COOL DOWN TIME) | SWITCH FROM SECOND IMAGE FORMING MODE TO FIRST IMAGE FORMING MODE | 50sec | 158sec | 79sec | 0sec |
| | SWITCH FROM COLOR ERASING MODE TO FIRST IMAGE FORMING MODE | 79sec | 389sec | 114sec | 0sec |
| | SWITCH FROM COLOR ERASING MODE TO SECOND IMAGE FORMING MODE | 29sec | 231sec | 35sec | 0sec |

FIG.9

SHEET PROCESSING APPARATUS AND IMAGE FORMING APPARATUS HAVING THE SAME

FIELD

Embodiments described herein relate generally to a sheet processing apparatus and an image forming apparatus having the sheet processing apparatus.

BACKGROUND

An image forming apparatus is capable of carrying out an image forming process with an erasable coloring material and a non-erasable coloring material. Another image forming apparatus is capable of carrying out an image erasing process of a fixed image formed with an erasable coloring material, using a fixing unit used for the image forming process. Such an image forming apparatus may be a printer, a multi function peripheral (MFP), and the like. A fixing temperature of an unfixed image may be different depending on the coloring material of the unfixed image, and an erasing temperature of a fixed image may also be different depending on the erasable coloring material of the fixed image. For example, when a fixing temperature of an unfixed image formed with an erasable coloring material is different from a fixing temperature of an unfixed image formed with a non-erasable coloring material, the image forming apparatus needs to change the fixing temperature according to the fixing target. However, it may take a significant amount of time for the image forming apparatus to increase and decrease the fixing or the erasing temperature when the target is switched. This process time may decrease usability of the image forming apparatus.

BRIEF DESCRIPTION OF THE DRAWINGS

FIG. 9 illustrates time required to switch the image forming mode under two different conditions.

DETAILED DESCRIPTION

Figure 1:
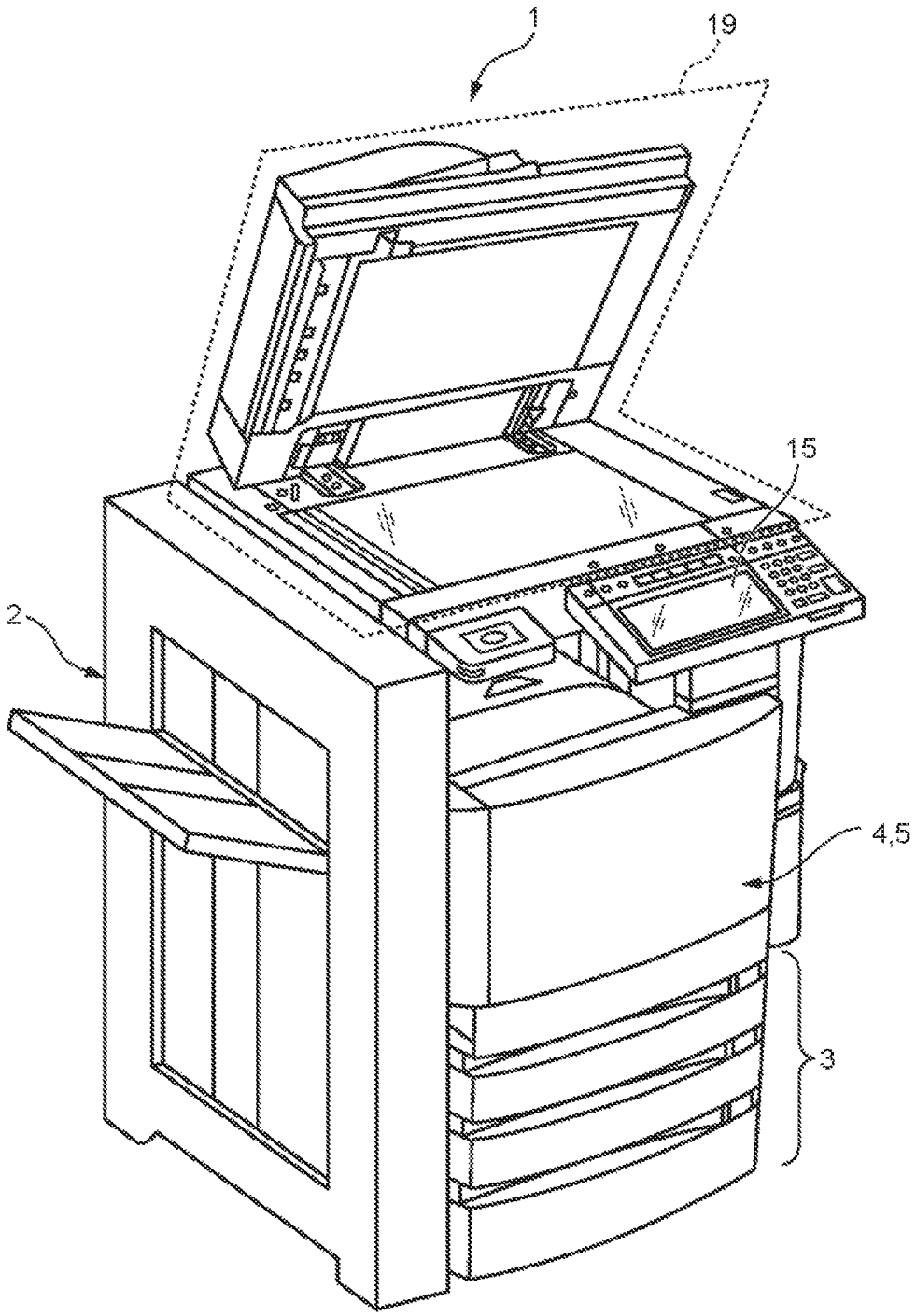
FIG. 1 is a schematic view of an image forming apparatus according to one embodiment.

In accordance with one embodiment, a sheet processing apparatus includes a rotating unit, a pressing unit, a nip through which a sheet passes being formed between the rotating unit and the pressing unit, a first heating unit configured to heat the rotating unit, a second heating unit configured to heat the pressing unit, and a control unit. The control unit is configured to control the first and the second heating units according to a mode of operation including a first mode and a second mode, such that, in the first mode, the rotating unit at the nip is at a first temperature and the pressing unit at the nip is at a second temperature, and in the second mode, the rotating unit at the nip is at a third temperature that is equal to or higher than the first temperature and the pressing unit at the nip is at a fourth temperature that is higher than the second temperature. A difference between the second and the fourth temperatures being smaller than a difference between the first and the third temperatures.

Embodiments for implementing the present invention are described hereinafter with reference to the accompanying drawings. Same components in each figure are shown with the same reference numerals, and therefore repeated description is omitted. The "color-erasing" in the present embodiment refers to making the image, which is formed in a color different from the ground color of the paper, invisible. Herein, the "color different from the ground color" includes not only chromatic color but also achromatic color such as white color, black color, and the like.

FIG. 1 is a schematic view of an image forming apparatus 1 according to an embodiment. The image forming apparatus 1 includes a paper feed section 3 arranged at the lower portion of a housing 2, an image forming section 4, a fixing section 5, an input panel 15, and an image reading section 19 arranged at the upper portion of the housing 2.

Figure 2:
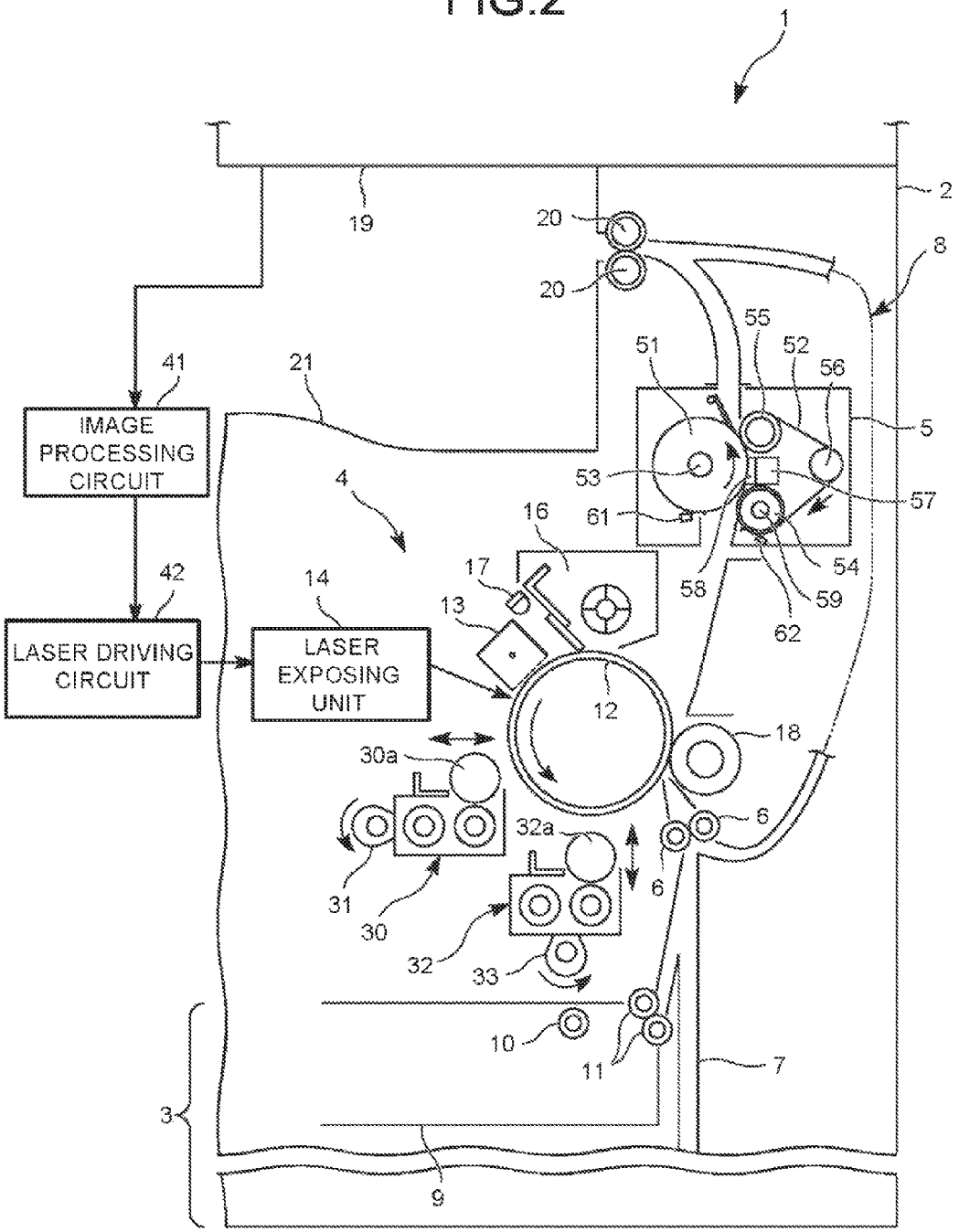
FIG. 2 is a cross-sectional view of the image forming apparatus.

FIG. 2 is a schematic cross-sectional view of the image forming apparatus 1. The paper feed section 3, the image forming section 4, the fixing section 5, and the image reading section 19 are arranged in the image forming apparatus 1 in sequence from the lower portion to the upper portion of the housing 2. The paper feed section 3 has a plurality of paper feed cassettes 9 arranged in the vertical direction. Only the top paper feed cassette 9 is shown in FIG. 2. In each paper feed cassette 9, unused (new) paper serving as a sheet to be subjected to image fixing processing or paper to be reused is stacked. The paper to be reused is paper to be subjected to color erasing processing for erasing an erasable toner image fixed thereon. The paper stacked in the paper feed cassette 9 is picked up one by one by a pickup roller 10. The paper picked up by the pickup roller 10 is conveyed towards a separation/conveyance roller pair 11. The separation/conveyance roller pair 11 conveys the paper conveyed by the pickup roller 10 towards a register roller pair 6 through a paper feed conveyance section 7. The paper from a double-sided paper feed section 8 for printing on both sides of the paper is also conveyed to the register roller pair 6, in addition to the paper conveyed through the paper feed conveyance section 7. The double-sided paper feed section 8 extends from a position above the fixing section 5 via a space between the fixing section 5 and the lateral side of the housing 2 towards the register roller pair 6.

The image forming section 4 includes a photoconductive drum 12. The photoconductive drum 12 is formed into a columnar shape and has organic photo conductors (OPC) around the outer peripheral surface thereof. The photoconductive drum 12 is rotated at a predetermined circumferential speed. The image forming section 4 further includes a corona charger 13, a laser exposing unit 14, a first developing device 30, a second developing device 32, a transfer roller 18, a cleaner 16, and a charge removing lamp 17.

The corona charger 13 is a scorotron-type charger for uniformly charging the outer peripheral surface of the photoconductive drum 12 to a negative polarity potential. The laser exposing unit 14 exposes the outer peripheral surface of the photoconductive drum 12. The first developing device 30 stores erasable toner as the erasable recording agent. The first developing device 30 develops an electrostatic latent image formed on the outer peripheral surface of the photoconductive drum 12 with the erasable toner when it is selected to form an image with the erasable toner. The development with the erasable toner is carried out through the reversal development by a developing roller 30*a* of the first developing device 30. The second developing device 32 stores non-erasable toner as the non-erasable recording agent. The second developing device 32 develops the electrostatic latent image formed on the outer peripheral surface of the photoconductive drum 12 with the non-erasable toner when it is selected to form an image with the non-erasable toner. The development with the non-erasable toner is carried out through the reversal development by a developing roller 32*a* of the second developing device 32. Whether to form an image with the erasable toner or the non-erasable toner is selected based on, for example, selection information input by a user through the input panel 15. The transfer roller 18 is arranged in such a manner that a constant load is applied to the photoconductive drum 12. The paper is conveyed by the register roller pair 6 to a transfer nip where the transfer roller 18 is contacted with the outer peripheral surface of the photoconductive drum 12 in synchronization with the formation of the toner image. The transfer roller 18 presses the paper against the photoconductive drum 12 in the transfer nip to transfer the toner image developed on the outer peripheral surface of the photoconductive drum 12 to the paper. When transferring the toner image to the paper, the transfer roller 18 applies a positive polarity transfer bias through a high-voltage source. The cleaner 16 removes and collects the toner that is not transferred to the paper and is left on the outer peripheral surface of the photoconductive drum 12. The charge removing lamp 17 removes the charge left on the outer peripheral surface of the photoconductive drum 12.

An image signal received by the image forming apparatus 1 from an external computer or an image signal obtained through digital conversion of the document image read by the image reading section 19 is input to an image processing circuit 41. The image processing circuit 41 carries out a predetermined image processing based on the image signal and output the image processing result to a laser driving circuit 42. The laser driving circuit 42 controls the laser exposing unit 14 based on the image processing result. The laser exposing unit 14 carries out, with a semiconductor laser, scanning of laser light on the outer peripheral surface of the photoconductive drum 12 with a predetermined resolution to form an electrostatic latent image on the outer peripheral surface of the photoconductive drum 12.

The electrostatic latent image formed on the outer peripheral surface of the photoconductive drum 12 is developed with the erasable toner stored in the first developing device 30 or the non-erasable toner stored in the second developing device 32. In a standby state during which image forming processing is not carried out, the first developing device 30 and the second developing device 32 are positioned at a certain distance away from the photoconductive drum 12. In an operation state during which image forming processing is carried out, either of the first developing device 30 or the second developing device 32 selected according to the selection information is moved to a position nearby the photoconductive drum 12. At this time, the developing roller 30*a* of the first developing device 30 or the developing roller 32*a* of the second developing device 32 is moved close to the photoconductive drum 12. The moving of the first developing device 30 is carried out with a cam 31. The moving of the second developing device 32 is carried out with a cam 33. When selected in the operation state, the first developing device 30 or the second developing device 32 is moved to a position near the photoconductive drum 12 and is connected with a driving source through a clutch (not shown). After being connected with the driving source, the developing roller 30*a* or the developing roller 32*a* is driven to rotate so as to supply toner to the outer peripheral surface of the photoconductive drum 12.

The first developing device 30 stores erasable two-component developing agent serving as a mixture of a magnetic carrier and the erasable toner charged to negative polarity. For example, the volume average particle diameter of the erasable toner is 10 μm, and the volume average particle diameter of the magnetic carrier is 40 μm. A toner concentration sensor is disposed in the first developing device 30. The toner concentration sensor detects the concentration of the erasable toner in the first developing device 30. When the concentration of the erasable toner is lower than a predetermined concentration, the erasable toner stored in an erasable toner cartridge in the image forming apparatus 1 is supplied to the first developing device 30.

The second developing device 32 stores non-erasable two-component developing agent serving as a mixture of a magnetic carrier and the non-erasable toner charged to negative polarity. For example, the volume average particle diameter of the non-erasable toner is 8 μm, and the volume average particle diameter of the magnetic carrier is 40 μm. Similar to the first developing device 30, the second developing device 32 has a toner concentration sensor. The toner concentration sensor detects the concentration of the non-erasable toner in the second developing device 32. When the concentration of the non-erasable toner is lower than a predetermined concentration, the non-erasable toner stored in anon-erasable toner cartridge in the image forming apparatus 1 is supplied to the second developing device 32.

The toner image formed on the outer peripheral surface of the photoconductive drum 12 with the erasable toner or the non-erasable toner is transferred to the paper passing through the transfer nip. The register roller pair 6 conveys the paper supplied from the paper feed conveyance section 7 or the double-sided paper feed section 8 to the transfer nip at predetermined timing. The paper to which the toner image formed with the erasable toner or the non-erasable toner is transferred is conveyed to the fixing section 5. The toner image transferred to the paper as an unfixed recording agent image is fixed on the paper through a processing carried out by the fixing section 5.

Toner that is not transferred to the paper and is left on the photoconductive drum 12 is removed by the cleaner 16. The charge removing lamp 17 removes the charge left on the outer peripheral surface of the photoconductive drum 12 after the toner left on the photoconductive drum 12 is removed. After the charge removing processing is carried out by the charge removing lamp 17, the corona charger 13 uniformly charges the outer peripheral surface of the photoconductive drum 12 for the next electrostatic latent image formation.

In addition, the image forming process for forming a toner image serving as an unfixed recording agent image on the paper described in the present embodiment is just exemplified as one example, and the present invention is not limited to this.

The paper on which the toner image is fixed at the fixing section 5 is conveyed towards a paper discharge roller pair 20. In a case of one-side printing, the paper on which the toner image is fixed is discharged to a paper discharge tray 21 by the paper discharge roller pair 20. In a case of duplex printing, the paper on the first surface of which the toner image is fixed is conveyed to the switchback type double-sided paper feed section 8 for printing on the second surface of the paper.

The paper conveyed to the double-sided paper feed section 8 is further conveyed to the register roller pair 6. The paper conveyed to the register roller pair 6 through the double-sided paper feed section 8 is further conveyed to the transfer nip at the timing of transferring the toner image to the second surface. The paper on the second surface of which the toner image is transferred is conveyed towards the fixing section 5. Then the paper of which the toner image on the second surface is fixed at the fixing section 5 is discharged to the paper discharge tray 21 by the paper discharge roller pair 20.

The fixing section 5 includes a cylindrical heating roller 51 serving as a fixing member and a pressing belt 52 serving as a pressing member, which is pressed against the heating roller 51 and rotated. The pressing belt 52 contacts the outer peripheral surface of the heating roller 51 over a given range to form a fixing nip. The heating roller 51 includes a heating roller lamp 53 serving as a second heat source therein. For example, a halogen lamp is used for the heating roller lamp 53. The diameter of the heating roller 51 can be set to 45 mm and the peripheral length of the pressing belt 52 can be set to 47 mm.

The pressing belt 52 is stretched with a certain tension applied by a belt heating roller 54, a pressing roller 55 and a tension roller 56. The belt heating roller 54 is positioned upstream of a pressing roller 55 in the paper conveyance direction in the fixing section 5. The belt heating roller 54 and the pressing roller 55 are positioned near the heating roller 51. Part of the pressing belt 52 stretched between the belt heating roller 54 and the pressing roller 55 is pressed against the heating roller 51 to contact the heating roller 51 in pressure. The pressing belt 52 is in contacted with the heating roller 51 in pressure so as to form the fixing nip. The tension roller 56 is located at a position away from the heating roller 51 than the positions of the belt heating roller 54 and the pressing roller 55. The tension roller 56 applies a force in a direction away from the tension roller 56 to the pressing belt 52 to cause a certain tension of the pressing belt 52. A pressure pad folder 57 is arranged inside the loop of the pressing belt 52. A pressure pad 58 is disposed on the pressure pad folder 57. The pressure pad 58 presses the pressing belt 52 against the heating roller 51 from the inside of the loop of the pressing belt 52 so that the pressing belt 52 is in contact with the heating roller 51 in pressure. The belt heating roller 54 is formed in a cylindrical shape. The belt heating roller 54 includes a pressing belt lamp 59 serving as a first heat source therein. For example, a halogen lamp is used for the pressing belt lamp 59. The diameter of the belt heating roller 54 can be set to 20 mm, the diameter of the pressing roller 55 can be set to 18 mm, and the width of the pressure pad 58 can be set to 10 mm.

A fixing member thermistor 61 is disposed in the fixing section 5 in the manner of contacting the outer peripheral surface of the heating roller 51. The fixing member thermistor 61 detects the surface temperature of the outer peripheral surface of the heating roller 51. A pressing member thermistor 62 is arranged in the manner of contacting a part of the pressing belt 52 that is in contact with the belt heating roller 54. The pressing member thermistor 62 detects the temperature of the surface of the pressing belt 52 that is in contact with the paper.

The heating roller 51 serving as the fixing member contacts the unfixed toner image formed on the paper at the fixing nip. The heating roller 51 has a release layer on, for example, an aluminum roller substrate having a wall thickness of 1.0 mm. The release layer on the roller substrate is formed by, for example, fluororesin PFA (copolymer of tetrafluoroethylene and Perfluoro alkyl vinyl ether) having a thickness of about 25 μm.

The pressing belt 52 serving as the pressing member is formed by laminating a silicone rubber layer on a nickel belt substrate and then laminating a release layer on the silicone rubber layer. For example, the thickness of the nickel belt substrate is about 40 μm, and the thickness of the silicone rubber layer is 200 μm. The fluororesin PFA is used for the release layer. The thickness of the fluororesin PFA of the release layer is about 30 μm.

The heating roller 51 is driven by a driving source to rotate from the upstream side of the conveyance direction towards the downstream side of the conveyance direction. The pressing belt 52 is rotated from the upstream side of the conveyance direction towards the downstream side of the conveyance direction in accordance with the rotation of the heating roller 51.

Figure 3:
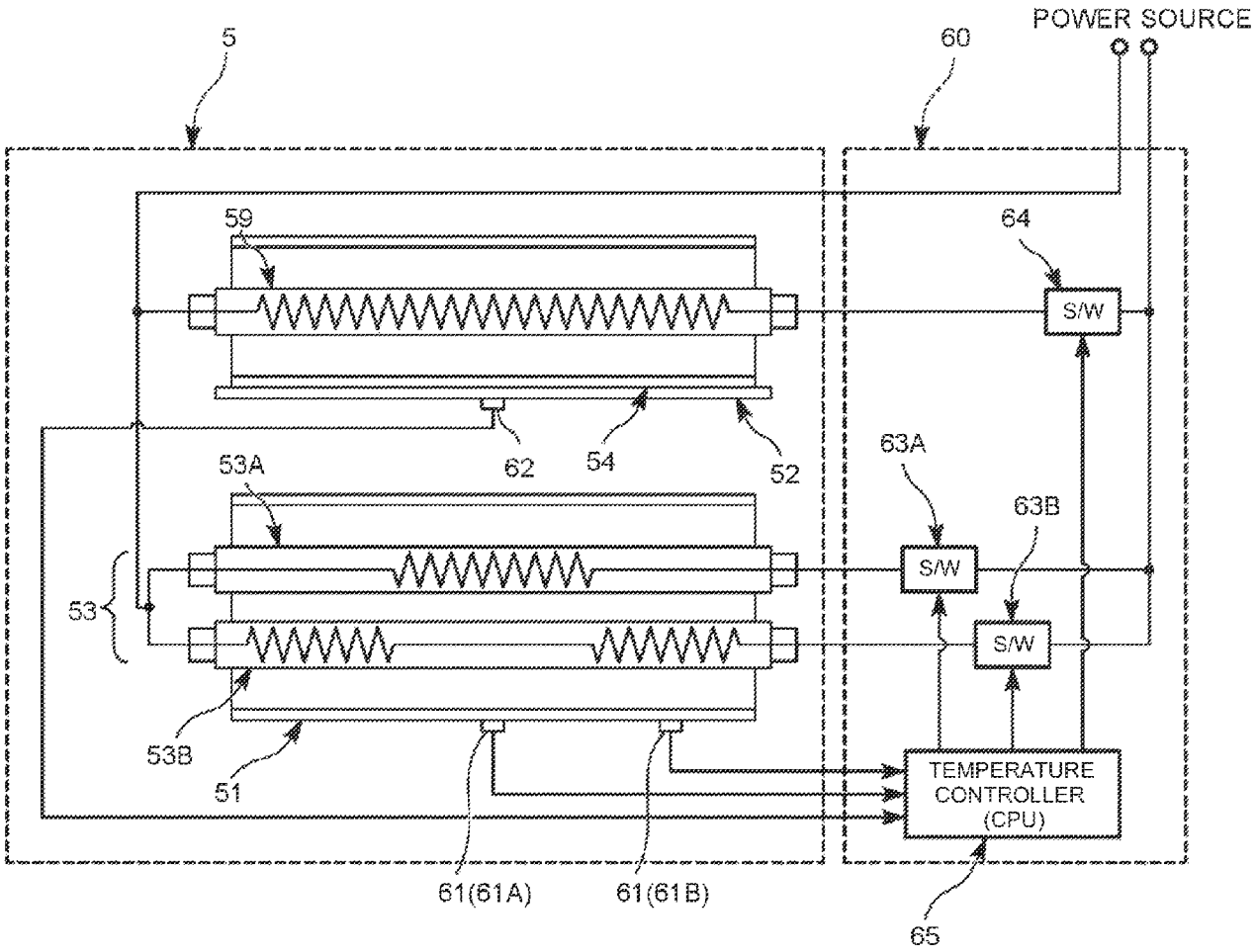
FIG. 3 illustrates a heat source mechanism in a fixing section of the image forming apparatus.

FIG. 3 illustrates heat source mechanism of the fixing section 5. The heating roller lamp 53 arranged inside the heating roller 51 includes a heating roller center lamp 53A and a heating roller side lamp 53B. The heating roller center lamp 53A heats the outer peripheral surface of the central part of the heating roller 51 in the center axis direction from inside. The heating roller side lamp 53B heats the outer peripheral surfaces of the two ends of the heating roller 51 in the center axis direction from inside. The pressing belt lamp 59 arranged inside the belt heating roller 54 heats the whole outer peripheral surface of the belt heating roller 54 from inside. For example, when the heating roller 51 is heated over a range corresponding to the width of A4-sized paper, the heating roller center lamp 53A is used. When the heating roller 51 is heated over a range corresponding to the length of A4-sized paper, both the heating roller center lamp 53A and the heating roller side lamp 53B are used. For example, a halogen lamp having an output of 300 W can be used for the heating roller center lamp 53A, the heating roller side lamp 53B, and the pressing belt lamp 59.

A temperature control section 60 controls the heating roller center lamp 53A, the heating roller side lamp 53B, and the pressing belt lamp 59. The temperature control section 60 includes a first, a second, and a third switching elements 63A, 63B, and 64 and a temperature controller 65. The first switching element 63A is arranged between the heating roller center lamp 53A and the power source. The second switching element 63B is arranged between the heating roller side lamp 53B and the power source. The third switching element 64 is arranged between the pressing belt lamp 59 and the power source. Each of the first, the second, and the third switching elements 63A, 63B, and 64 is controlled by the temperature controller 65. The temperature controller 65 respectively turns on or turns off the first, the second, and the third switching elements 63A, 63B, and 64 to control the heating. For example, bidirectional thyristors are used for the first, the second, and the third switching elements 63A, 63B, and 64. The power source for supplying power to the heating roller center lamp 53A, the heating roller side lamp 53B, and the pressing belt lamp 59 may be, for example, a commercial-use AC power source.

The fixing member thermistor 61 includes a center thermistor 61A and a side thermistor 61B. The center thermistor 61A detects the temperature of the outer peripheral surface of the central part of the heating roller 51 in the center axis direction. The side thermistor 61B detects the temperature of the outer peripheral surface of either a first end or a second end of the heating roller 51 in the center axis direction. Each of the center thermistor 61A and the side thermistor 61B sends the detected temperature to the temperature controller 65. The temperature controller 65 inputs the temperatures detected by the center thermistor 61A and the side thermistor 61B as temperature information. For example, when the paper to be subjected to toner image fixing processing is A4-sized paper, the temperature controller 65 reduces the energization time of the heating roller side lamp 53B. In this way, the temperature of the outer peripheral surface at the two ends of the heating roller 51 will not rise to a temperature above a predetermined temperature.

The pressing member thermistor 62 detects the surface temperature of the central part of the pressing belt 52 in the width direction. The pressing member thermistor 62 sends the detected temperature to the temperature controller 65. The temperature controller 65 inputs the temperature detected by the pressing member thermistor 62 as temperature information.

Figure 4:
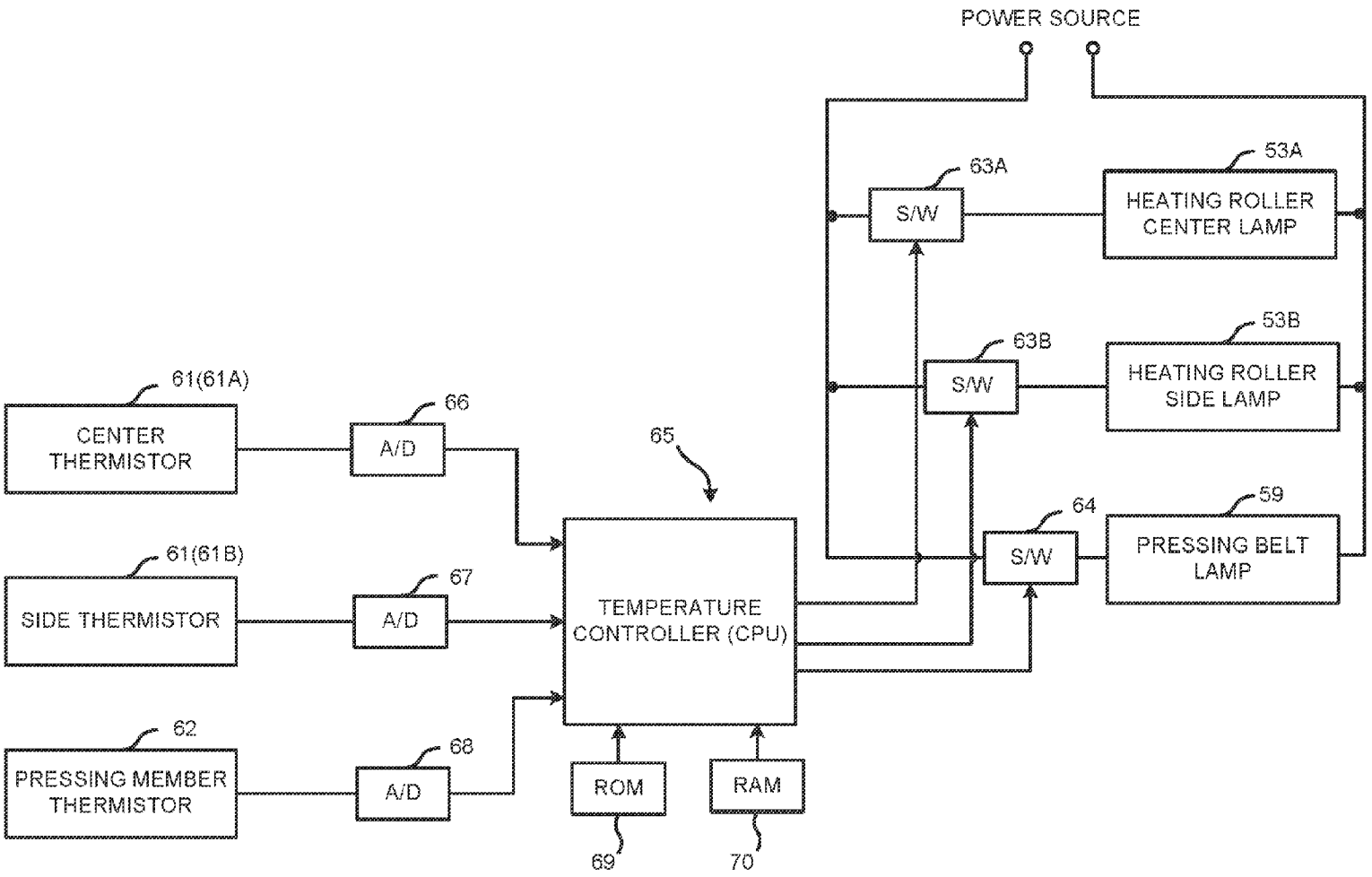
FIG. 4 is a block diagram of the heat source mechanism.

FIG. 4 is a block diagram of the heat source mechanism of the fixing section 5. As shown in FIG. 4, the center thermistor 61A is connected with the temperature controller 65 through an A/D converter 66. The temperature detected by the center thermistor 61A is converted into temperature information as a digital signal by the A/D converter 66. The side thermistor 61B is connected with the temperature controller 65 through an A/D converter 67. The temperature detected by the side thermistor 61B is converted into temperature information as a digital signal by the A/D converter 67. The pressing member thermistor 62 is connected with the temperature controller 65 through an A/D converter 68. The temperature detected by the pressing member thermistor 62 is converted into temperature information as a digital signal by the A/D converter 68. The temperature controller 65 inputs the temperature information converted by the A/D converters 66, 67, and 68. The temperature controller 65 is connected with an ROM 69 and an RAM 70. Programs according to which the temperature controller 65 executes the temperature control are stored in the ROM 69. A plurality of control parameters including the control temperature of each of the belt heating roller 54 and the pressing belt 52 in the temperature control is stored in the ROM 69 in advance. The RAM 70 temporarily stores the parameters used by the temperature controller 65 in the temperature control. The parameters temporarily stored by the RAM 70 includes, for example, the temperature information indicating the temperatures of the belt heating roller 54 and the pressing belt 52 acquired by the temperature controller 65 and the like.

Figure 5:
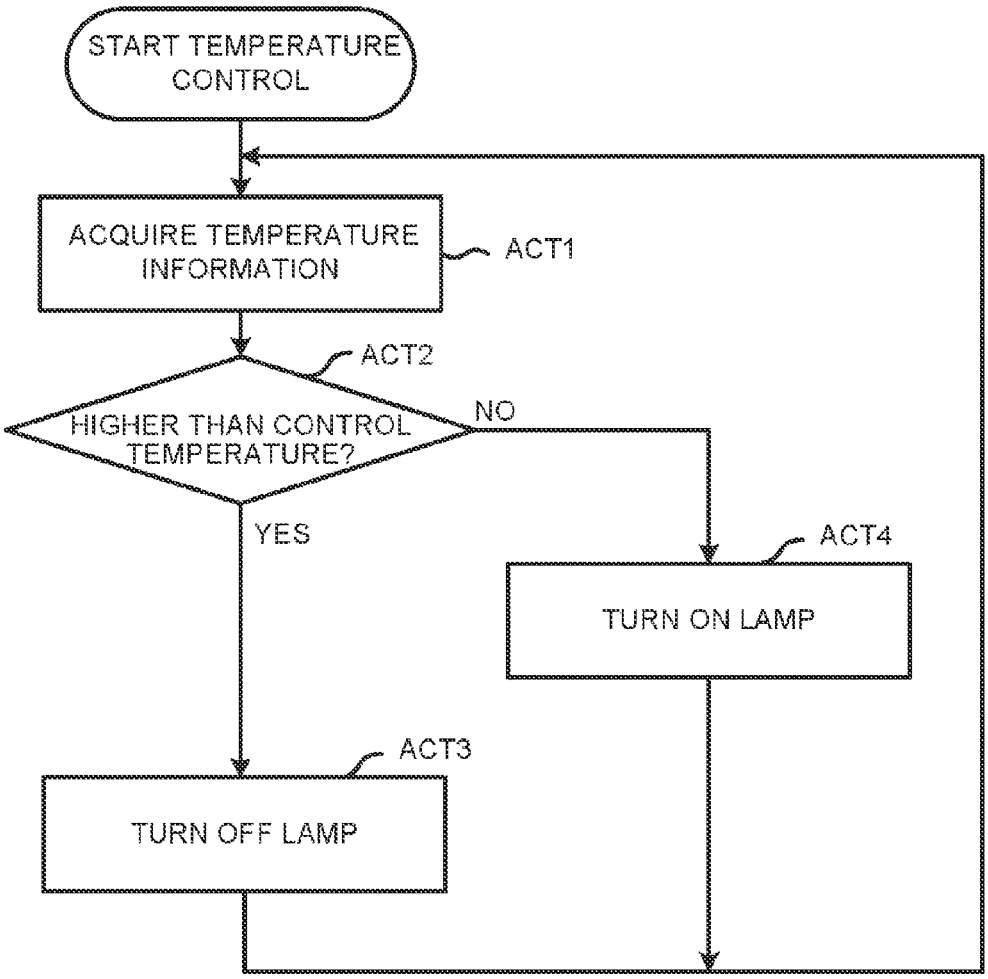
FIG. 5 is a flowchart of a temperature control carried out by a temperature controller of the heat source mechanism.

FIG. 5 is a flowchart of the temperature control carried out by the temperature controller 65. The temperature controller 65 carries out the temperature control for each of the heating roller center lamp 53A, the heating roller side lamp 53B, and the pressing belt lamp 59. When the temperature control is started, the temperature controller 65 acquires temperature information (ACT 1). The temperature controller 65 determines whether or not the temperature indicated by the acquired temperature information is higher than a control temperature (ACT 2). When the temperature is higher than the control temperature (YES in ACT 2), the temperature controller 65 turns off the switching element and stops the power supply for the lamp to turn off the lamp (ACT 3). After turning off the switching element, the temperature controller 65 returns to ACT 1 to repeat the process following ACT 1. When the temperature is not higher than the control temperature (NO in ACT 2), the temperature controller 65 turns on the switching element and supplies power for the lamp to turn on the lamp (ACT 4). After turning on the switching element, the temperature controller 65 returns to ACT 1 to repeat the process following ACT 1.

Through the temperature control described above, the temperature controller 65 maintains the surface temperature of each of the heating roller 51 and the pressing belt 52 at the control temperature. The control temperature for the heating roller 51 and the control temperature for the pressing belt 52 are determined separately. In addition, different control temperatures are determined when the toner image is formed with erasable toner and when the toner image is formed with non-erasable toner.

For example, when an image is formed with the erasable toner, the process speed of the image forming apparatus 1 is 136 mm/sec. The process speed refers to a moving speed of the outer peripheral surface of the photoconductive drum 12 and a paper conveyance speed when the paper passes through the transfer nip and the fixing nip. When the process speed is 136 mm/sec, the image forming apparatus 1 can process thirty sheets of A4-sized paper per minute. Further, when an image is formed with the non-erasable toner, the process speed of the image forming apparatus 1 is 210 mm/sec. When the process speed is 210 mm/sec, the image forming apparatus 1 can process forty five sheets of A4-sized paper per minute. The print speed in a case of using non-erasable toner is 1.5 times as fast as the print speed in a case of using erasable toner. When color erasing processing is carried out on the paper on which the erasable toner is fixed, the process speed of the image forming apparatus 1 is 136 mm/sec. When the color erasing process speed is 136 mm/sec, the image forming apparatus 1 can process thirty sheets of A4-sized paper per minute. When the length of the fixing nip of the fixing section 5 in the conveyance direction is about 21 mm, and the process speed is 136 mm/sec, the paper can pass through the fixing nip in 0.154 sec. When the length of the fixing nip in the conveyance direction is about 21 mm, and the process speed is 210 mm/sec, the paper can pass through the fixing nip in 0.1 sec.

The toner image formed on the paper is heated and pressed at the fixing section 5 to be fixed on the paper. In order to fix the toner image formed with the erasable toner on the paper without erasing the toner image, it is necessary that the fixing section 5 heats the toner image at a temperature lower than a color erasing temperature. That is, in a case of fixing the erasable toner, the temperature controller 65 needs to control the surface temperature of each of the heating roller 51 and the pressing belt 52 below the color erasing temperature. Further, in order to uniformly heat the toner image formed on the paper, the surface temperature of the heating roller 51 may be controlled to be the same as or approximate to the surface temperature of the pressing belt 52.

The toner image formed with the non-erasable toner is not erased, and therefore, there is no limit on the temperature when fixing the toner image formed with the non-erasable toner. When the surface temperature of the outer peripheral surface of the heating roller 51 is sufficiently high, the toner image can be sufficiently fixed on the paper even if the print speed is high.

Operational modes of the image forming apparatus 1 according to the present embodiment include a first image forming mode for forming an image with the erasable toner and a second image forming mode for forming an image with the non-erasable toner. The user of the image forming apparatus 1 operates, for example, the input panel 15 to switch between the first image forming mode and the second image forming mode. The temperature control of the fixing section 5 in the first image forming mode is different from that in the second image forming mode. Specifically, the surface temperature of the outer peripheral surface of the heating roller 51 and the surface temperature of the pressing belt 52 in the first image forming mode is different from the surface temperature of the outer peripheral surface of the heating roller 51 and the surface temperature of the pressing belt 52 in the second image forming mode. When the image forming mode is switched, certain time is needed before the surface temperatures of the heating roller 51 and the pressing belt 52 are changed to the corresponding control temperature.

Figure 6:
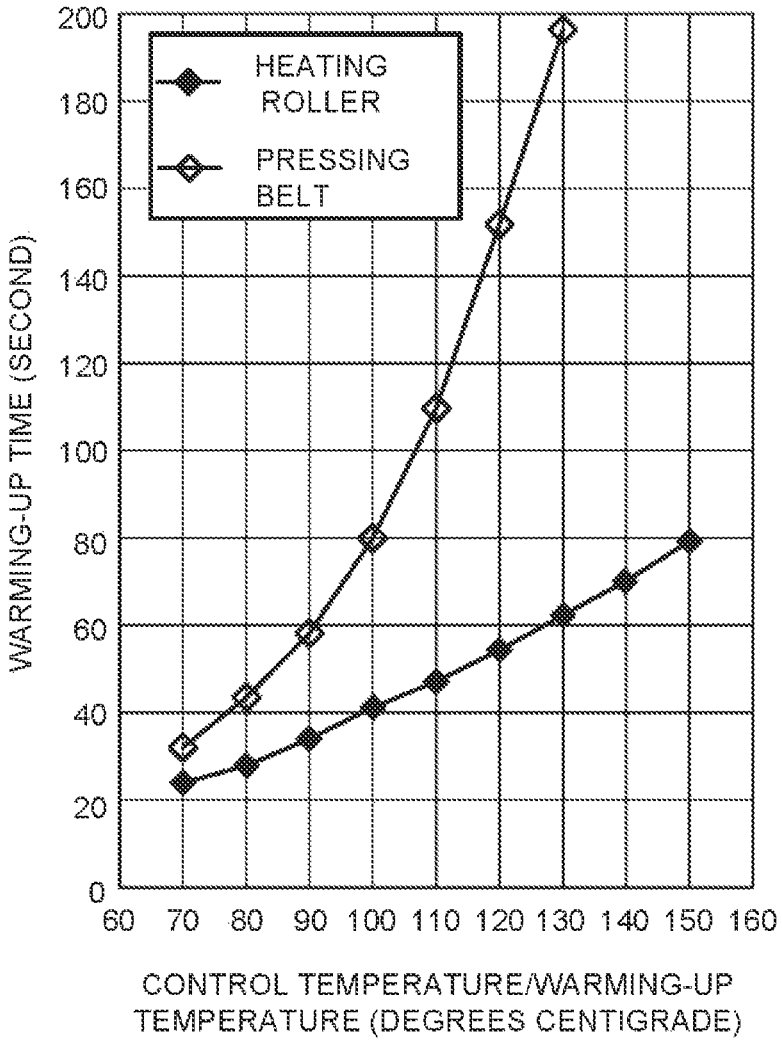
FIG. 6 is a graph showing a relationship between a time required to change the surface temperatures of a heating roller 51 and a pressing belt 52 from an ordinary temperature to a control temperature.

Hereinafter, the temperature control for reducing the time required to change the surface temperatures of the heating roller 51 and the pressing belt 52 to the control temperature is described. FIG. 6 is a graph showing a relationship between the time required to change the surface temperatures of the heating roller 51 and the pressing belt 52 from an ordinary temperature to the control temperature. Herein, the ordinary temperature is set to 23 degrees centigrade. In the graph shown in FIG. 6, the abscissa indicates the control temperature/warming-up temperature, and the ordinate indicates the warming-up time. As shown in the graph in FIG. 6, the higher the control temperature is, the longer the warming-up time serving as the time required for the rise of the surface temperature is. Particularly, the warming-up time of the pressing belt 52 increases exponentially as the control temperature increases. That is because the heat transferred from the belt heating roller 54 to the pressing belt 52 diffuses to the pressure pad 58, the pressing roller 55, and the tension roller 56.

In a case of fixing the erasable toner, an evaluation result indicates that the proper control temperature of the heating roller 51 is 100 degrees centigrade and the proper control temperature of the pressing belt 52 is 90 degrees centigrade. The color erasing starting temperature of the erasable toner in the evaluation is 109 degrees centigrade. The print speed in the evaluation is thirty sheets of paper per minute.

Figure 7:
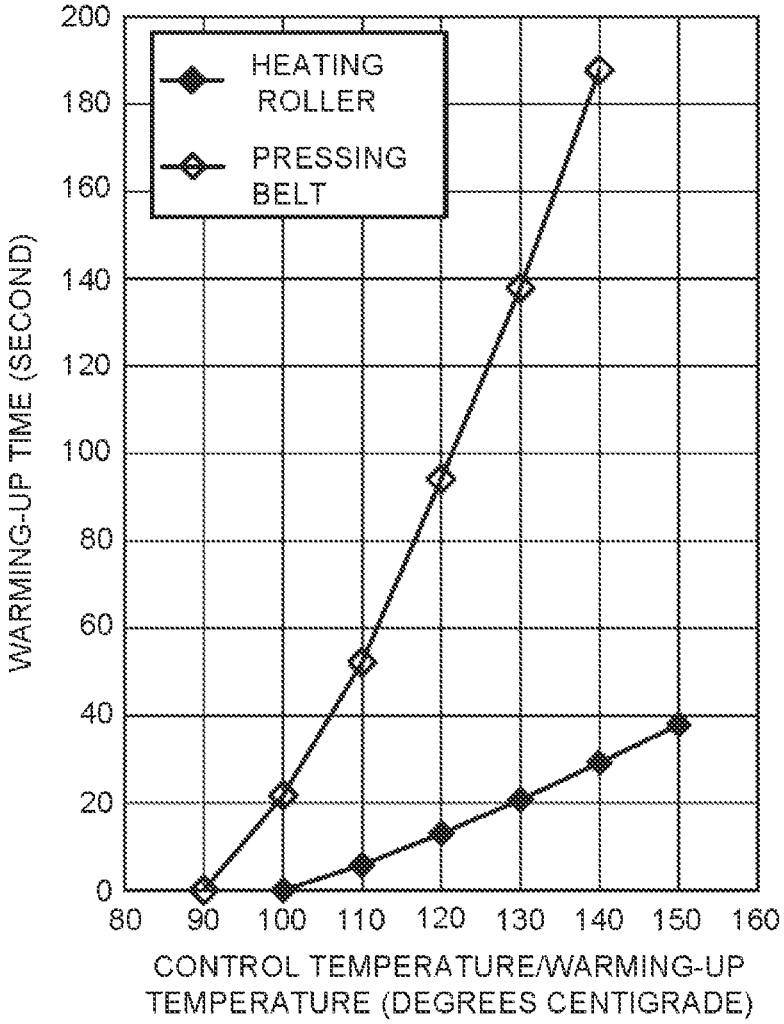
FIG. 7 is a graph showing a relationship between a time required to change the surface temperatures of the heating roller 51 and the pressing belt 52 in a case of switching from a first image forming mode to a second image forming mode.

FIG. 7 is a graph showing a relationship between the time required for the change of the surface temperatures of the heating roller 51 and the pressing belt 52 in a case of switching from the first image forming mode to the second image forming mode. In the graph shown in FIG. 7, the abscissa indicates the control temperature/warming-up temperature, and the ordinate indicates the warming-up time. As shown in the graph in FIG. 7, similar to the case of changing from the ordinary temperature to the control temperature, the higher the control temperature is, the longer the time required for the rise of the surface temperature is. Further, the warming-up time of the pressing belt 52 increases exponentially as the control temperature increases.

In a case of fixing the non-erasable toner, an evaluation result indicates that the proper value of the control temperature of the heating roller 51 is 120 degrees centigrade when the control temperature of the pressing belt 52 is 110 degrees centigrade. And an evaluation result indicates that the proper value of the control temperature of the heating roller 51 is 130 degrees centigrade when the control temperature of the pressing belt 52 is 90 degrees centigrade.

Figure 8:
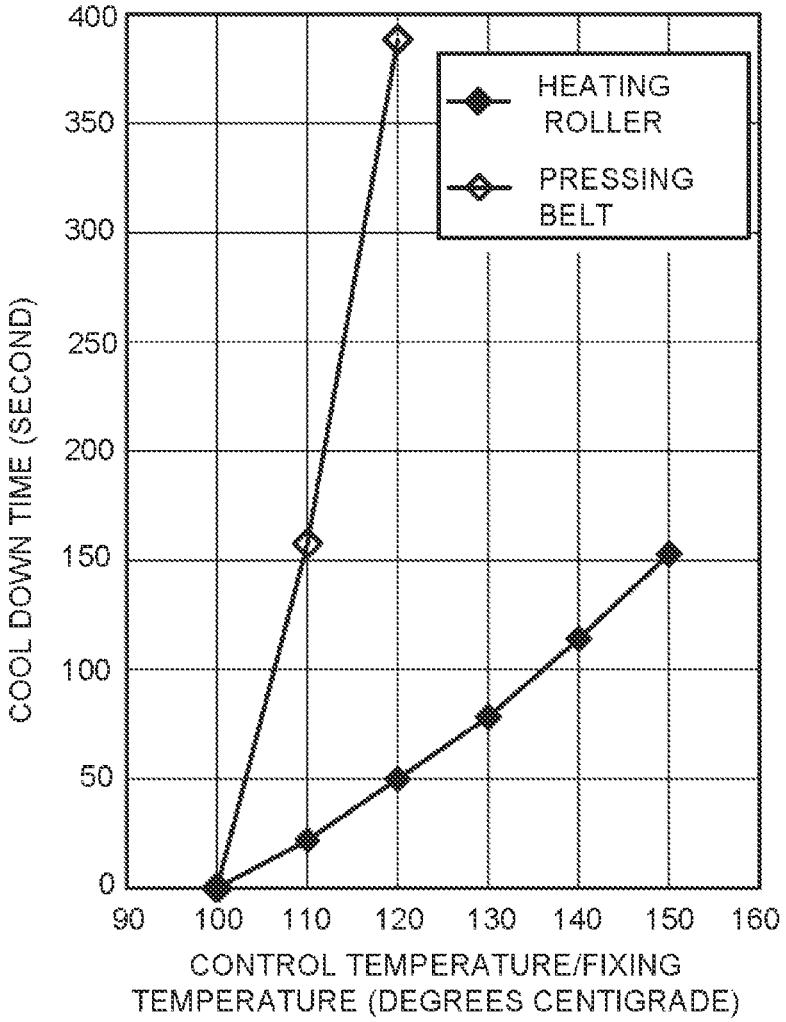
FIG. 8 is a graph showing a relationship between a time required to change the surface temperatures of the heating roller 51 and the pressing belt 52 in a case of switching from the second image forming mode to the first image forming mode.

FIG. 8 is a graph showing a relationship between the time required for the change of the surface temperatures of the heating roller 51 and the pressing belt 52 in a case of switching from the second image forming mode to the first image forming mode. In the graph shown in FIG. 8, the abscissa indicates the control temperature/fixing temperature, and the ordinate indicates the cool down time. After the image forming apparatus 1 continuously carries out image forming processing on 500 sheets of A4-sized paper, the time required for the change of the surface temperature is measured. The control temperature in the second image forming mode is 100 degrees centigrade. The cool down time serving as the time required for the decrease of the surface temperature refers to the time required to decrease the surface temperature from the control temperature in the first image forming mode to 100 degrees centigrade. As shown in the graph in FIG. 8, the higher the control temperature in the first image forming mode is, the longer the cool down time is. Particularly, the cool down time of the pressing belt 52 increases exponentially as the control temperature in the first image forming mode increases. That is because much heat is stored in the pressure pad 58, the pressing roller 55, and the tension roller 56 through the processing carried out on the 500 sheets of paper. The heat of the pressing belt 52 can hardly diffuse due to the heat stored in the pressure pad 58, the pressing roller 55, and the tension roller 56; thus, a long time is required to decrease the surface temperature of the pressing belt 52.

As shown in the graphs in FIGS. 6-8, the time required to increase or decrease the surface temperature of the pressing belt 52 is longer than the time required to increase or decrease the surface temperature of the heating roller 51. It is known that the time required for the switch of the image forming mode can be reduced if the control temperatures of the pressing belt 52 in the first image forming mode and the second image forming mode are the same. FIG. 9 illustrates results obtained by measuring the time required for the switch of the image forming mode under two different conditions. In a first condition, the control temperatures of the pressing belt 52 in the first image forming mode and the second image forming mode are set to 90 and 110 degrees centigrade, respectively. In a second condition, the control temperatures of the pressing belt 52 in the first image forming mode and the second image forming mode are set to be the same, that is, 90 degrees centigrade. FIG. 9 shows that the time required for the switch of the image forming mode is reduced if the control temperatures of the pressing belt 52 in the first and the second image forming modes are the same.

The temperature controller 65 carried out a temperature control so that the difference between the control temperatures of the pressing belt 52 in the first and the second image forming modes is smaller than the difference between the control temperatures of the heating roller 51. For example, the temperature controller 65 carries out a temperature control to set the control temperature of the heating roller 51 to 100 degrees centigrade and set the control temperature of the pressing belt 52 to 90 degrees centigrade in the first image forming mode. Further, the temperature controller 65 carries out a temperature control to set the control temperature of the heating roller 51 to 130 degrees centigrade and set the control temperature of the pressing belt 52 to 90 degrees centigrade in the second image forming mode. That is, the difference between the control temperatures of the pressing belt 52 in the first and the second image forming modes is 0 degrees centigrade, and the difference between the control temperatures of the heating roller 51 in the first and the second image forming modes is 30 degrees centigrade. As the temperature controller 65 carried out the temperature control described above, in this way, the time required for the switch of the image forming mode is reduced, and usability of the image forming apparatus is improved.

The temperature controller 65 may set the control temperature of the pressing belt 52 in each of the first and the second image forming modes to a constant temperature. Then the temperature controller 65 may switch the control temperature of the heating roller 51 in each of the first and the second image forming modes.

The temperature controller 65 may operates to increase the difference between the surface temperatures of the heating roller 51 contacting the unfixed toner image in the first and the second image forming modes. The time required for fixing processing can be reduced by setting the surface temperature of the heating roller 51 to a sufficiently high temperature in the second image forming mode for fixing the toner image formed with the non-erasable toner. In this way, the image forming apparatus 1 can improve the print speed in the second image forming mode.

Further, the temperature control section 65 may carry out the same temperature control on the surface temperatures of the pressing belt 52 in the first image forming mode and the second image forming mode. As the control temperature of the pressing belt 52 is made not to be changed, it is possible to reduce the time required for the change of the surface temperature of the pressing belt 52 when the image forming mode is switched. As the time required for the switch of the image forming mode is reduced, usability of the image forming apparatus is improved.

In addition, in the present embodiment, the control temperatures of the pressing belt 52 in the first and the second image forming modes are the same. However, the present invention is not limited to this. The difference between the control temperatures of the pressing belt 52 is allowed as long as it is in such a range that the time required for the change of the surface temperature of the pressing belt 52 is shorter than the time required for the change of the surface temperature of the heating roller 51.

In the present embodiment, the selection of the toner in the image forming section 4 is carried out by determining whether to use the first developing device 30 or the second developing device 32 in the development. However, the present invention is not limited to this. As to the selection of the toner in the image forming section 4, the electrostatic latent image may be developed for each color with a well-known image forming apparatus for carrying out color printing. Specifically, it may be determined whether to use a rotary development system or a revolver development system in which a plurality of developing devices are selected in sequence to develop the electrostatic latent image on the photoconductive drum 12. Further, it may be determined to use a tandem development system in which the toner image is formed on the intermediate transfer belt nearby the photoconductive drum of each of the plurality of developing devices and then transferred to the paper. Moreover, in the present embodiment, the image forming apparatus 1 forms the toner image with one kind of non-erasable toner. However, the present invention is not limited to this. The image forming apparatus 1 may form the toner image with a plurality of kinds of non-erasable toner. For example, the image forming apparatus 1 may use the cyan, yellow, magenta, and black toner used in the color printing as the non-erasable toner to form the toner image.

Further, in the present embodiment, the surface temperature of each of the heating roller 51 and the pressing belt 52 is detected by the thermistors. However, the present invention is not limited to this. The center thermistor 61A, the side thermistor 61B, and the pressing member thermistor 62 may be temperature sensors other than the thermistors.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A sheet processing apparatus, comprising:

a rotating unit;

a pressing unit, a nip through which a sheet passes being formed between the rotating unit and the pressing unit;

a first heating unit configured to heat the rotating unit;

a second heating unit configured to heat the pressing unit;

a control unit configured to control the first and the second heating units according to a mode of operation including a first mode and a second mode, such that, in the first mode, the rotating unit at the nip is at a first temperature and the pressing unit at the nip is at a second temperature, and in the second mode, the rotating unit at the nip is at a third temperature that is higher than the first temperature and the pressing unit at the nip is at a fourth temperature that is equal to or higher than the second temperature, a difference between the second and the fourth temperatures being smaller than a difference between the first and the third temperatures; and a sheet conveying unit configured to convey a sheet having an unfixed image formed thereon towards the nip, the unfixed image formed with an erasable material in the first mode and with a non-erasable material in the second mode.

2. The sheet processing apparatus according to claim 1, wherein the second temperature is equal to the fourth temperature.

3. The sheet processing apparatus according to claim 1, wherein the mode of operation includes a third mode, the control unit is further configured to control the first and the second heating units, such that, in the third mode, the rotating unit at the nip is at a fifth temperature that is higher than the third temperature and the pressing unit at the nip is at a sixth temperature that is higher than the fourth temperature, and in the third mode, a sheet having a fixed image formed thereon with an erasable material is conveyed by the sheet conveying unit towards the nip.

4. The sheet processing apparatus according to claim 1, wherein a time to heat up the rotating unit by a predetermined temperature is shorter than a time to heat up the pressing unit by the predetermined temperature, and a time to cool down the rotating unit by the predetermined temperature is shorter than a time to cool down the pressing unit by the predetermined temperature.

5. The sheet processing apparatus according to claim 1, wherein the rotating unit includes a first roller that is rotatable in a sheet conveying direction, the first heating unit includes a center heating unit that is disposed within the first roller at a central region thereof along a direction of a rotational axis of the first roller, and an end heating unit that is disposed within the first roller at an end region thereof along the direction of the rotational axis, the pressing unit includes a pressing belt, a second roller that is rotatable in association with a movement of the pressing belt, and an urging member urging the pressing belt towards the rotating unit at the nip, and the second heating unit is disposed within the second roller at an entire region thereof along a direction of a rotational axis of the second roller.

6. A method for processing a sheet using a sheet processing apparatus having a rotating unit and a pressing unit, a nip through which a sheet passes being formed therebetween, the method comprising:

in a first mode, heating the rotating unit at the nip at a first temperature and the pressing unit at the nip at a second temperature, and conveying a sheet having an unfixed image formed with an erasable material towards the nip; and in a second mode, heating the rotating unit at the nip at a third temperature that is higher than the first temperature and the pressing unit at the nip at a fourth temperature that is equal to or higher than the second temperature, and conveying a sheet having an unfixed image formed with a non-erasable material towards the nip, a difference between the second and the fourth temperatures being smaller than a difference between the first and the third temperatures.

7. The method according to claim 6, wherein the second temperature is equal to the fourth temperature.

8. The method according to claim 6, further comprising:

in a third mode, heating the rotating unit at the nip at a fifth temperature that is higher than the third temperature and the pressing unit at the nip at a sixth temperature that is higher than the fourth temperature; and in the third mode, conveying a sheet having a fixed image formed with an erasable material to the nip.

9. The method according to claim 6, wherein a time to heat up the rotating unit be a predetermined temperature is shorter than a time to heat up the pressing unit by the predetermined temperature, and a time to cool down the rotating unit by the predetermined temperature is shorter than a time to cool down the pressing unit by the predetermined temperature.

10. An image forming apparatus comprising:

an image forming section configured to form an unfixed image on a sheet;

a fixing section configured to fix the unfixed image onto the sheet; and a sheet conveying section configured to convey the sheet from the image forming section towards the fixing section, wherein the fixing section includes a rotating unit, a pressing unit, a nip through which a sheet passes being formed between the rotating unit and the pressing unit, a first heating unit configured to heat the rotating unit, a second heating unit configured to heat the pressing unit, and a control unit configured to control the first and the second heating units according to a mode of operation including a first mode and a second mode, such that, in the first mode, the rotating unit at the nip is at a first temperature and the pressing unit at the nip is at a second temperature, and in the second mode, the rotating unit at the nip is at a third temperature that is higher than the first temperature and the pressing unit at the nip is at a fourth temperature that is equal to or higher than the second temperature, a difference between the second and the fourth temperatures being smaller than a difference between the first and the third temperatures, and wherein a sheet having an unfixed image formed thereon with an erasable material is conveyed by the sheet conveying section towards the nip in the first mode, and a sheet having an unfixed image formed thereon with a non-erasable material is conveyed by the sheet conveying section towards the nip in the second mode.

11. The image forming apparatus according to claim 10, wherein the second temperature is equal to the fourth temperature.

12. The image forming apparatus according to claim 10, wherein the mode of operation includes a third mode, the control unit is further configured to control the first and the second heating units, such that, in a third mode, the rotating unit at the nip is at a fifth temperature that is higher than the third temperature and the pressing unit at the nip is at a sixth temperature that is higher than the fourth temperature, and in the third mode, a sheet having a fixed image formed thereon with an erasable material is conveyed by the sheet conveying section towards the nip.

13. The image forming apparatus according to claim 10, wherein a time to heat up the rotating unit by a predetermined temperature is shorter than a time to heat up the pressing unit by the predetermined temperature, and a time to cool down the rotating unit by the predetermined temperature is shorter than a time to cool down the pressing unit by the predetermined temperature.

14. The image forming apparatus according to claim 10, wherein the rotating unit includes a first roller that is rotatable in a sheet conveying direction, the first heating unit includes a center heating unit that is disposed within the first roller at a central region thereof along a direction of a rotational axis of the first roller, and an end heating unit that is disposed within the first roller at an end region thereof along the direction of the rotational axis, the pressing unit includes a pressing belt, a second roller that is rotatable in association with a movement of the pressing belt, and an urging member urging the pressing belt towards the rotating unit at the nip, and the second heating unit is disposed within the second roller at an entire region thereof along a direction of a rotational axis of the second roller.

* * * * *